US005617921A

United States Patent [19]

Schmidt et al.

[11] Patent Number: 5,617,921

[45] Date of Patent: Apr. 8, 1997

[54] OVER-PRESSURED WELL FRACTURING WITH SURFACE RESERVOIR AND ACTUATOR SYSTEM

[75] Inventors: Joseph H. Schmidt; Keith R. Ferguson; Andrew J. Bond, all of Anchorage; Roger F. Keese, Eagle River, all of Ak.

[73] Assignees: Atlantic Richfield Company, Los Angeles, Calif.; Schlumberger Technology Corporation, Houston, Tex.

[21] Appl. No.: 535,978

[22] Filed: Sep. 29, 1995

[51] Int. Cl.[6] ..... E21B 43/26; E21B 43/267

[52] U.S. Cl. ..... 166/308; 166/63; 166/177.5

[58] Field of Search ..... 166/299, 63, 308, 166/297, 177.5, 271, 273

[56] References Cited

U.S. PATENT DOCUMENTS

| | | | |
|---|---|---|---|
| 4,064,935 | 12/1977 | Mohaupt | 166/63 |
| 4,081,031 | 3/1978 | Mohaupt | 166/299 |
| 4,633,951 | 1/1987 | Hill et al. | 166/308 |
| 4,683,943 | 8/1987 | Hill et al. | 166/63 |
| 4,683,951 | 8/1987 | Pathak et al. | 166/271 |
| 4,823,875 | 4/1989 | Hill | 166/280 |
| 5,074,359 | 12/1991 | Schmidt . | |
| 5,271,465 | 12/1993 | Schmidt et al. . | |
| 5,370,187 | 12/1994 | Ferguson et al. . | |
| 5,411,098 | 5/1995 | Schmidt et al. | 166/369 |

*Primary Examiner*—Frank Tsay
*Attorney, Agent, or Firm*—Michael E. Martin

[57] ABSTRACT

Fractures are initiated or extended into fluid producing earth formations from a well by providing a reservoir of high pressure gas at the earth's surface together with a flow control valve or a frangible closure, such as a shear disk, interposed in a conduit connecting the reservoir to the well. The well is precharged with high pressure gas at a pressure less than or about the same as the reservoir gas pressure. Fracture initiation and/or extension may be carried out by firing the perforation gun and opening the flow control valve between the reservoir and the wellhead in timed relation or by allowing a pressure drop across a shear disk interposed between the reservoir and the wellhead to effect rupture of the shear disk to release the reservoir charge. In wells where perforations are already formed, a shear disk or other frangible closure in the well tubing may be ruptured to release a precharge of high pressure gas in the tubing string to begin fracture formation or extension followed by flow of high pressure gas discharged from the reservoir to continue the fracture initiation or extension.

20 Claims, 2 Drawing Sheets

OVER-PRESSURED WELL FRACTURING WITH SURFACE RESERVOIR AND ACTUATOR SYSTEM

BACKGROUND OF THE INVENTION

1. Field of the Invention

The present invention relates to a method and system for fracturing an earth formation from a wellbore by overpressuring a tubing string and/or casing with pressure gas applied from a surface reservoir and actuator system for releasing gas to initiate and propagate the fracture.

2. Background

In fracturing earth formations from wells to stimulate the production of fluids therefrom, a longstanding problem has been the inability to sustain high pressure and flow of fracturing fluid during the fracture initiation and extension process. In deviated wells, in particular, inadequate fluid pressure and flow conditions at fracture initiation will produce a near wellbore kink in the fracture which will tend to restrict the flow of fluids to or from the wellbore once the fracture has been formed. U.S. Pat. No. 5,074,359, issued Dec. 24, 1991, to Joseph H. Schmidt and assigned to the assignee of the present invention discusses the problem of improper fracture formation from deviated wells, in particular.

Conventional fracturing techniques are also limited by the inability to provide the fracture fluid at sufficiently high flow rate to sustain formation breakdown pressure once fracture initiation or breakdown occurs. In conventional fracturing techniques, the fracture fluid is supplied at a predetermined pressure from surface disposed pumps and friction pressure losses through the pumping system and the wellbore conduits leading to the fractures zone often preclude adequate fracture extension once formation breakdown occurs. One solution to the above-mentioned fracture initiation and extension problem is described and claimed in U.S. Pat. No. 5,271,465 to Schmidt et al. and also assigned to the assignee of the present invention. The '465 patent describes and claims an over-pressured well fracturing method wherein a pressure gas charge is built up in a wellbore conduit or tubing string prior to perforation of the well casing so that, upon firing a perforation gun to perforate the casing, a substantial amount of fluid energy is available for fracture initiation and extension. Alternatively, in accordance with the '465 patent, if the well has already been perforated, a shear disk or other releasable closure member is interposed in the tubing string, preferably at the lower end thereof and a fluid pressure charge is built up in the tubing string to the point of release of the closure member or shear disk to provide a high energy charge of pressure fluid to flow through the perforations into the formation.

The above-described method is particularly advantageous for wells which have relatively large diameter tubing strings which may hold a sufficient charge of pressure gas to provide adequate fracture fluid pressure and flow characteristics. If the well is relatively shallow or the tubing diameter is relatively small, less than about 6.0 inches, for example, a sufficient charge of pressure gas may be provided by precharging a tubing string disposed in an adjacent well and connecting the tubing strings together by suitable conduit means. This method is described in U.S. Pat. No. 5,370,187 to Keith R. Ferguson and Joseph H. Schmidt and also assigned to the assignee of the present invention.

However, an "accumulator" well as described above is not always available closely adjacent to the well from which the over-pressured fracture initiation or extension method is desired to be performed. Moreover, since shallow wells and/or wells with relatively small diameter tubing and/or casing do not have adequate reservoir capacity for the fracture fluid charge, a surface disposed reservoir is desirable. However, heretofore the fluid pressure and volume requirements for initiating fractures have presented certain problems with respect to providing a suitable operating method and a structurally adequate reservoir and flow control mechanism for releasing the high pressure fluid to flow into and through the well to initiate or extend a fracture.

SUMMARY OF THE INVENTION

The present invention provides an improved method for initiating and/or extending a fracture in an earth formation from a well penetrating the formation utilizing a source of high pressure fracturing fluid disposed on the earth's surface and which is released to flow into and through the well at a predetermined time to initiate and/or extend the fracture.

In accordance with one aspect of the present invention, a fracture initiation and/or extension method is carried out by providing a source of high pressure fracturing fluid, particularly an inert gas, in a surface reservoir connected to a wellhead and a tubing string or casing extending within the well and wherein release of pressure fluid to flow through the well is initiated by a control signal which opens a valve or by a pressure differential acting across a closure member such as a frangible disk or the like.

In accordance with another aspect of the present invention, a method for initiating and/or extending a fracture into an earth formation from a well is provided which is particularly advantageous for relatively shallow wells or wells which have relatively small diameter tubing strings therein or which otherwise do not have adequate high pressure fluid storage capacity for storing a charge of fracture fluid to be released to flow into an earth formation.

The present invention further provides an improved method for initiating and/or extending fractures into an earth formation from a well wherein the well is evacuated of liquid, a charge of pressure gas is pumped into the well in the vicinity of the earth formation zone to be fractured, a source of high pressure gas charge is disposed at the surface and connected to the well and the well casing is then perforated at the zone to be fractured. Such action allows the gas charge in the well to flow into the formation zone and to effect sustained flow of the gas by releasing the charge disposed at the earth's surface to flow into and through the well and into the formation zone being fractured. Control over release of pressure gas to flow into the well from the surface may be carried out by relying on a pressure differential to release a frangible closure member or by coordinated control of a casing perforating operation and operation of a valve to release pressure gas to flow through the well and into the formation.

The present invention still further provides a unique system for initiating and/or extending fractures into an earth formation from a well, which system includes a surface reservoir and actuator system for providing a high pressure gas charge for flow into and through the well to initiate and/or extend fractures therefrom.

Those skilled in the art will further appreciate the above-mentioned features and advantages of the invention together with other superior aspects thereof upon reading the detailed description which follows in conjunction with the drawing.

DESCRIPTION OF PREFERRED EMBODIMENT

Figure 1:
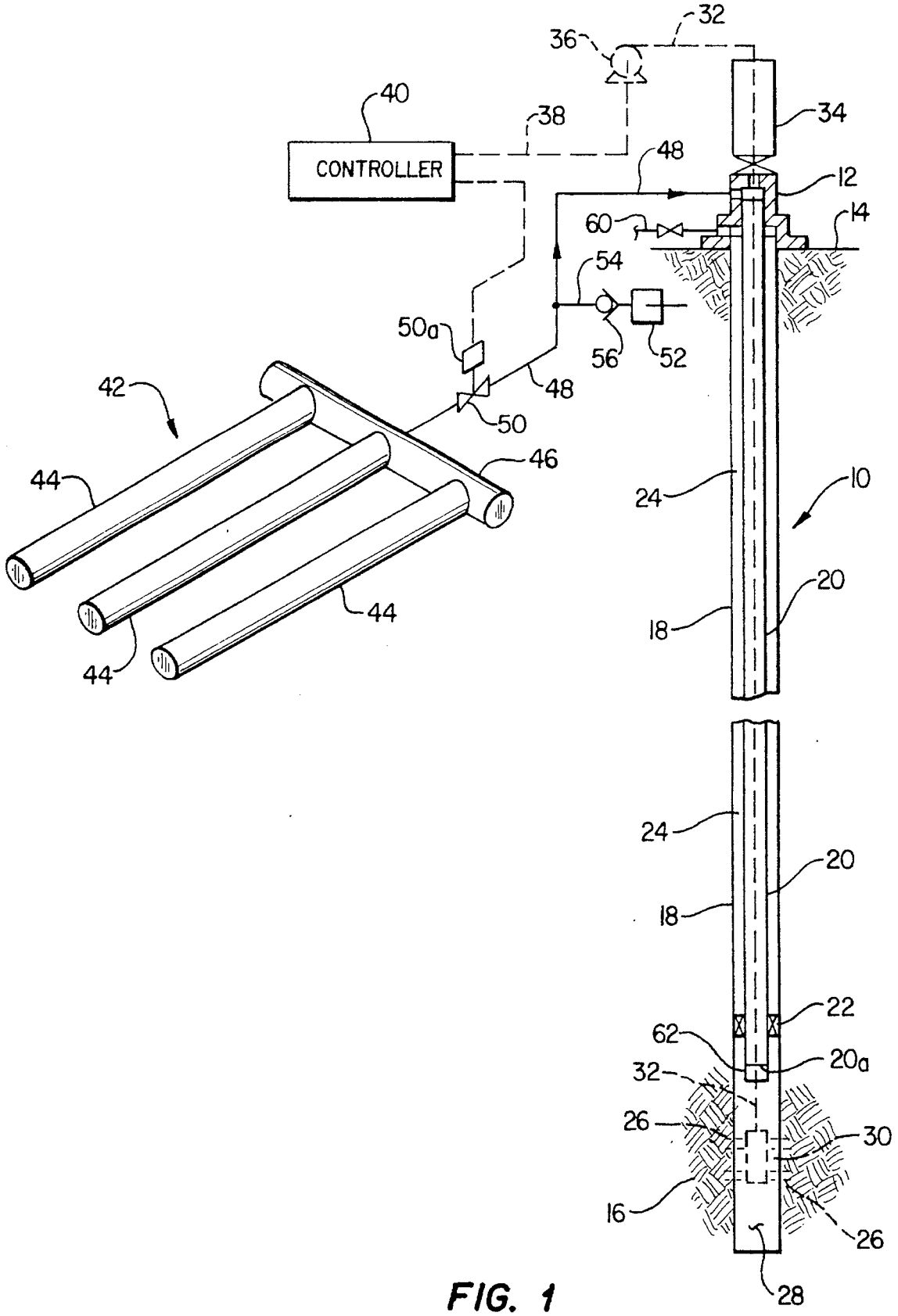
FIG. 1 is a schematic diagram of a well adapted to be fractured by a fracturing method using a surface reservoir system in accordance with the present invention.

In the description which follows, like elements are marked throughout the specification and drawing with the same reference numerals, respectively. The drawing figures are not to scale in the interest of clarity and conciseness.

Referring to FIG. 1, there is illustrated an improved arrangement for carrying out a high pressure fracturing operation on an earth formation zone of interest which has been penetrated by a well, generally designated by the numeral 10. The well 10 is shown extending from a conventional wellhead 12 at the earth's surface 14 to a subterranean formation zone of interest 16 which may be capable of producing useful fluids therefrom or which may be fractured to accept fluids for storage or for driving other fluids to a production well or wells. The well 10 also includes a conventional cylindrical metal casing 18 extending between the wellhead 12 and the formation zone 16. An elongated tubing string 20 is interposed in the casing 18 and extends from the wellhead 12 to a lower distal end 20*a*. A conventional packer 22 is interposed between the lower end of the tubing string 20 and the casing 18 to form an elongated closable annulus space 24, in a conventional manner.

The well 10 may or may not already include perforations or openings 26 in the casing 18 adjacent the zone of interest 16 for placing a wellbore space 28 in communication with the zone of interest. In any event, the perforations 26 may be formed by a conventional perforating "gun" 30 which may be lowered into the well on a conventional control cable 32 which extends between the perforating gun and the wellhead 12, on which is shown mounted a conventional wireline lubricator 34. The cable 32 extends through the lubricator 34 to a cable winding drum 36, and suitable electrical conductor means in the cable 32 is operable to be in communication with a signal transmitting conductor 38 connected to a controller 40. Suitable control signals may be transmitted from the controller 40 by way of the conductor 38 and cable 32 to the perforating gun 30 to cause same to form the perforations 26 in a known manner.

There are many wells which are or may be drilled into earth formation zones disposed at relatively shallow depths from the earth's surface, on the order of 1,500 feet to 10,000 feet, for example. Such wells typically have working tubing strings, such as the tubing string 20, having nominal diameters of 2.5 inches to 3.0 inches maximum. Although formation zones, such as the zone 16, may benefit from a high pressure, high flow rate fracturing technique, such as described in U.S. Pat. Nos. 5,271,465 and 5,370,187, both of which are incorporated herein by reference, the volume of the tubing string 20 may be insufficient to hold a suitable quantity of fracturing fluid, such as pressure gas, to perform a satisfactory fracture operation. Accordingly, the present invention contemplates an improved method of fracturing the formation zone 16 utilizing at least some of the basic principles described in the above-mentioned patents.

As shown in FIG. 1, a source of high pressure gas is provided at the surface 14 in the form of a reservoir 42 which may, for example, hold as much as about 500,000 standard cubic feet of nitrogen at a nominal pressure of 9,000 psig to 10,000 psig at a nominal temperature of 100° F. The reservoir 42 may be constructed to minimize the risk of structural failure at the pressures indicated above. For example, the reservoir 42 may be made up of 9,625 inch diameter high pressure well casing having a 10,000 psig pressure rating. The reservoir 42 may be constructed of plural sections of casing 44 as indicated. The reservoir sections 44 are connected to a manifold or header 46 which may be formed of the same casing as provided for the sections 44. The reservoir 42 may be suitably fabricated, using conventional pressure vessel fabrication techniques, to form a pressure vessel of the structure comprising the casing sections 44 and the manifold or header 46. The number of reservoir sections 44 illustrated is exemplary and the volume of pressure gas required will dictate the size and number of reservoir sections. The use of the above-mentioned casing sections for forming the reservoir 42 is exemplary but advantageous in that this type of casing is commercially available in most oilfield environments.

The reservoir 42 is connected to the wellhead 12 by a conduit 48 having a suitable rapid opening motor operated valve 50 interposed therein. The valve motor or actuator 50a may be a high pressure hydraulic actuator, for example, suitably controlled to open a ball or plug type closure member. The conduit 48 is in flow communication with the tubing string 20 for conducting high pressure gas through the tubing string to the wellbore space 28. FIG. 1 also shows a source of relatively high pressure gas, such as a compressor 52, connected to the conduit 48 by way of a conduit 54 having a suitable check valve 56 interposed therein. The compressor 52 is operable to charge the wellbore space 28 and the tubing string 20 with pressure gas. Still further, the casing annulus 24 is in communication with a conduit 60 connected to the wellhead 12 through which pressure fluid may be introduced into the annulus 24 to reduce the pressure differential acting on the tubing string 20 from high pressure gas therein.

In performing a high pressure fracturing operation through the well 10, using the system shown in FIG. 1, the wellbore space 28 may or may not contain a quantity of liquid, the level of which may or may not extend up into the tubing string 20. Liquid may be evacuated from the tubing string 20 and wellbore space 28 using methods described in U.S. Pat. No. 5,271,465. Preferably, substantially all liquid is evacuated from the wellbore space 28 and the tubing string 20 prior to initiating a fracturing operation in accordance with the invention.

If the perforations 26 have not already been formed, the perforating gun 30 is placed in the wellbore space 28 in the position shown and the tubing string 20 and the wellbore space 28 is charged with pressure gas from a source such as the compressor 52, for example. By way of example, pressure may be raised in the wellbore space 28 and the tubing string 20 to about 9,000 psig to 10,000 psig using nitrogen gas as the working fluid. Prior to initiation of the fracturing operation, the reservoir 42 is also charged with pressure nitrogen from a suitable source to a working pressure of about 9,000 psig to 10,000 psig, for example. In all events, the reservoir pressure is raised to a value at least as great as, and preferably slightly greater than, the pressure in the wellbore space 28 and tubing string 20.

In the system of FIG. 1, the controller 40 is adapted to operate the valve 50 to open in timed relationship to firing of the perforation gun 30 to form the perforations 26. Accordingly, once the wellbore space 28 and the tubing string 20 have been pumped to the aforementioned working pressure by a source, such as the compressor 52, and the reservoir 42 is suitably charged to its working pressure mentioned above, the controller is then operated to actuate the perforating gun 30 to form the perforations 26 while, in timed relationship, the valve 50 is opened. Once the perforations 26 were formed, pressure gas in the wellbore space 28 and the tubing string 20 flows rapidly through the perforations to act on the formation zone 16 to initiate and/or extend multiple fractures therethrough. Release of pressure gas from the reservoir 42 to flow through the tubing string 20 and the wellbore space 28 provides a continuing flow of pressure gas or a second high pressure pulse of gas flowing into and through the perforations 26 to further form or extend fractures in the formation zone 16. Timing of opening of the valve 50 may be correlated with firing of the perforation gun 30 and may be dependent on the length and diameter of the tubing string 20 and the volume of the wellbore space 28.

It may not be necessary to evacuate all liquid from the wellbore space 28 since the presence of the liquid may assist in initiating and extending-fractures in the zone 16. The liquid may include a proppant mixed therein to assist in maintaining the fractures in an open condition after the fracturing pressure subsides. However, the energy expended in accelerating the liquid to flow into the formation zone 16 may be better utilized to initiate or extend the fractures themselves and in this regard it is therefore, often, more advantageous to carry out the fracturing operation entirely with pressure gas.

Fractures may also be initiated and/or extended into the zone 16 if the perforations 26 have already been formed. The wellbore space 28 and the tubing string 20 may be pressurized by charging these spaces with pressure gas from the compressor 52, for example, up to a pressure which is slightly less than the formation breakdown pressure in the zone 16. Once this condition has been achieved, the valve 50 may be separately controlled to open to allow a substantially higher pressure charge of gas to flow from the reservoir 42 through the tubing string 20, the wellbore space 28 into the formation zone 16 to initiate or extend wellbore fractures therein.

Still further, the distal end 20*a* of the tubing string 20 may be fitted with a shear disk apparatus, generally designated by the numeral 62, and of a type similar to that shown and described in U.S. Pat. No. 5,370,187. The apparatus 62 may be adapted to provide for rupture or release of a shear disk or other suitable closure at a predetermined pressure. Under such an operating condition, the tubing string 20 would be pressurized to a suitable pressure slightly less than the rupture pressure of the shear disk apparatus 62, followed by opening of the valve 50, at will, to provide a high pressure pulse sufficient to rupture the disk and allow gas to flow at extremely high velocities and pressures through the tubing string 20, the wellbore space 28 and the perforations 26 into the formation zone 16. Alternatively, the tubing string 20 may be pumped to an intermediate pressure by the compressor 52 sufficient to actuate the shear disk 62 and opening of valve 50 in timed relation thereto.

Figure 2:
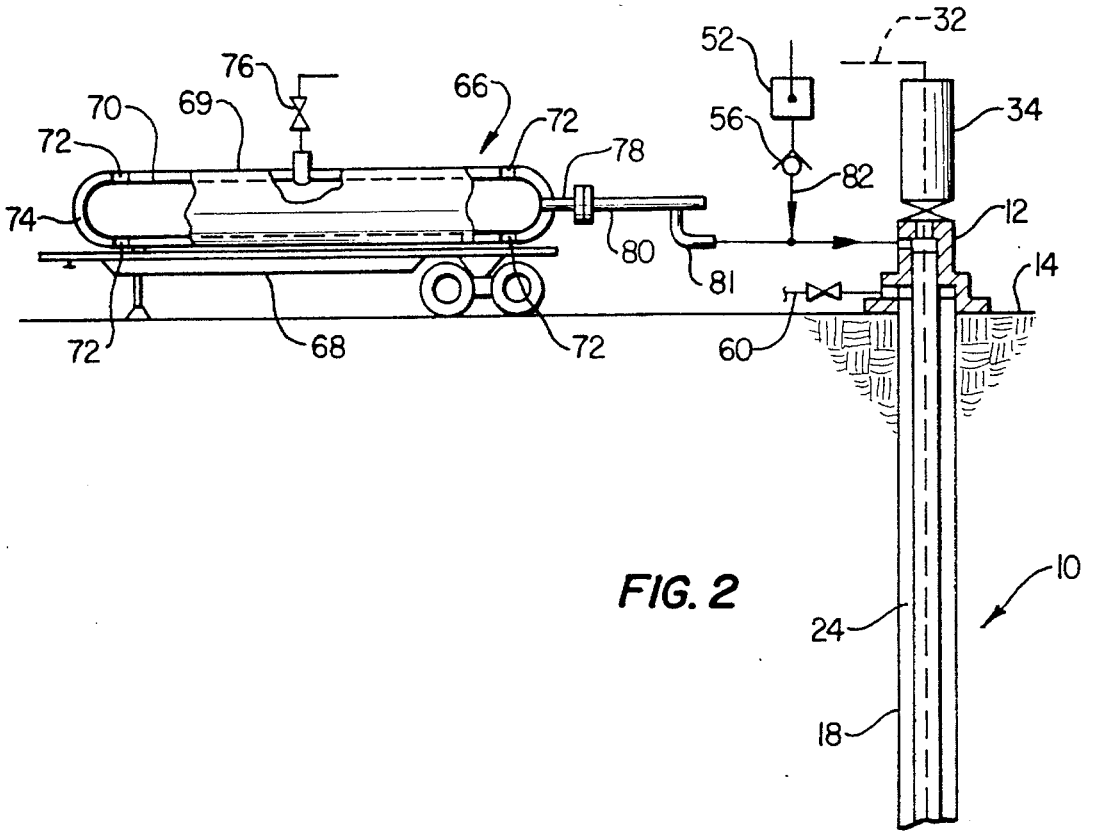
FIG. 2 is a schematic diagram of an alternate embodiment of the invention.

Referring now to FIG. 2, the formation zone 16 may also be subjected to a fracture treatment in accordance with the invention using a source of high pressure gas on the earth's surface 14 comprising a mobile reservoir, generally designated by the numeral 66. The reservoir 66 is adapted to be mounted on a conventional semitrailer 68 or other suitable transport vehicle for movement to and from wells requiring a fracturing treatment in accordance with the invention. The reservoir 66 may be utilized in place of the reservoir 42 with the system illustrated in FIG. 1 or in accordance with the system illustrated in FIGS. 2 and 3. Alternatively, the reservoir 42 may be used in place of reservoir 66 in the system illustrated in FIGS. 2 and 3. The reservoir 66 comprises an outer, generally cylindrical elongated pressure vessel 69 and an inner, cylindrical elongated pressure vessel 70 disposed within the pressure vessel 69 and supported generally uniformly spaced therefrom by suitable spacer means 72, as shown.

Accordingly, a substantially uniform annular space 74 is provided between the vessels 69 and 70 which may be pressurized with a suitable liquid such as an ethylene glycol-water mixture to a pressure of about 4,000 psig to reduce the pressure differential across the inner pressure vessel 70 when it is charged with pressure gas. The inner pressure vessel 70 may be about six feet in diameter by forty feet in length for holding a charge of nitrogen gas at a pressure of between 9,000 psig and 10,000 psig in the quantity and conditions mentioned above for a gas charge within the reservoir 42. The inner pressure vessel 70 is connected to a suitable pressure relief valve 76 and is provided with a gas discharge conduit 78 which is connected to a conduit extension 80. The conduit extension 80 is adapted to support a shear disk apparatus or other frangible closure member therein in a manner described hereinbelow. The discharge conduit extension 80 includes a main branch portion 81 connected to the wellhead 12 in place of the conduit 48 of the embodiment shown in FIG. 1. A branch conduit 82 is connected to the conduit 81 and to a suitable compressor 52 for supplying pressure gas to the wellhead 12 and tubing string 20.

Figure 3:
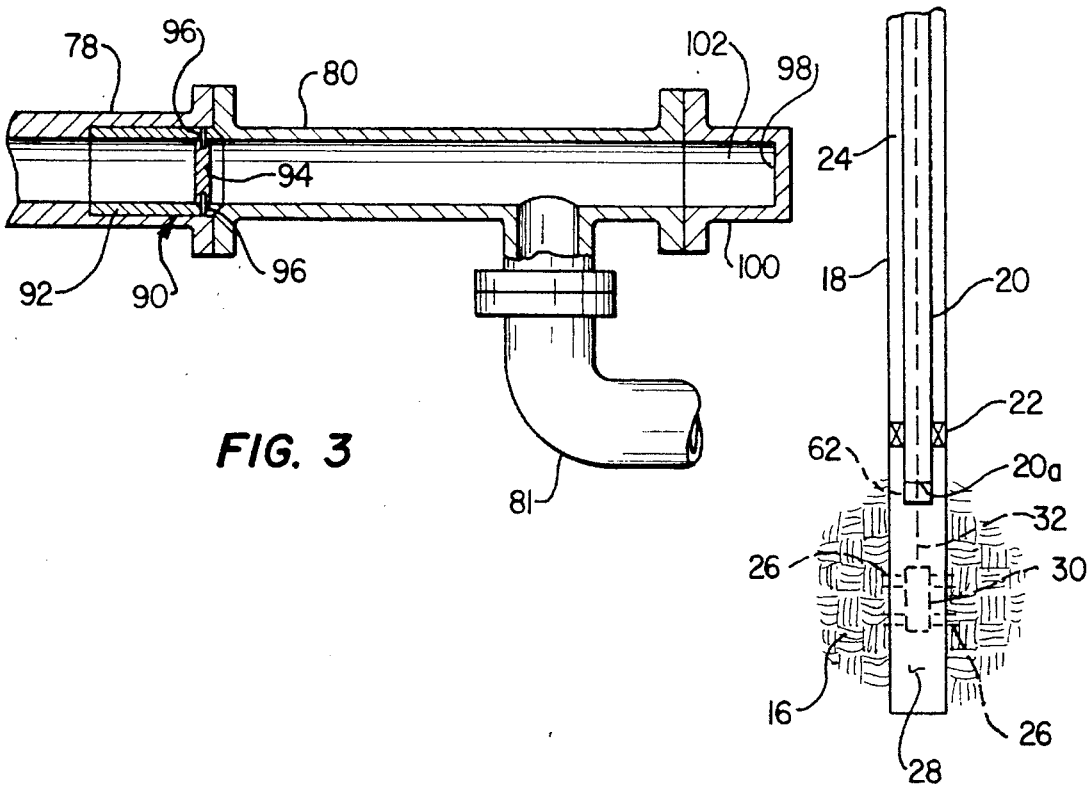
FIG. 3 is a detail view of a shear disk type frangible closure and discharge conduit arrangement for the reservoir shown in FIG. 2.

FIG. 3 shows one arrangement for releasing pressure gas from the pressure vessel 70 which comprises a shear disk assembly 90 including a supporting sleeve 92 disposed in the discharge conduit 78, a shear disk closure member 94 and spaced apart shear pins 96 which support the disk in the sleeve 92. At a predetermined pressure acting on the disk 94, the pins 96 are operable to shear to allow the disk to move rapidly through the conduit 80 into a recess 98 formed in a distal end portion 100 of the conduit 80 and preferably filled with a quantity of material which is operable to form a cushion and trap for the disk, since it will be released and accelerated to extremely high velocities. A plug 102 of soft material, such as lead or a thick petroleum grease, may be used, for example. Upon release of the shear disk 94 or fracture thereof, it is propelled into the trap provided by the plug 102 and pressure gas flows at very high velocities and pressures through the conduit 81 to the tubing string 20. As mentioned previously, a suitable motor operated control valve, such as the valve 50, may be interposed in the conduit 78, 80 in place of the shear disk assembly 90.

The well 10 may be prepared for a high pressure fracture treatment using the system shown in FIG. 2 in the same manner that the well is prepared using the system shown in FIG. 1. Preferably, essentially all liquid is removed from the wellbore space 28, which process can be carried out using a technique similar to that described in U.S. Pat. No. 5,271,465. Alternatively, some liquid may be left in the wellbore space 28 to assist in initiation or extension of fractures in the zone 16. If the perforations 26 have not been formed, the wellbore space 28 and the tubing string 20 are pressurized up to a pressure of about 9,000 psig to 10,000 psig, for example. Nitrogen gas may be used as the pressure gas to achieve the charge pressure and supplied by compressor 52. The reservoir 66 is charged with pressure gas in the pressure vessel 70 up to the same or slightly greater working pressure of about 9,000 psig to 10,000 psig. A pressure differential of less than the rupture pressure of the shear disk 94 is, of course, required to be maintained across the shear disk to prevent premature actuation thereof.

If the perforation gun 30 is placed in its working position shown in FIG. 2 and the wellbore space 28 and tubing string 20 are pressurized to the pressure mentioned above, upon firing of the perforation gun to form the perforations 26, a rapid pressure drop will occur within the tubing string 20, the wellbore space 28 and the conduit 80, 81 to create a pressure differential across the shear disk 94 of sufficient magnitude to effect shearing of the pins 96 and rapid deployment of the shear disk 94 into the trap formed by plug 102. Accordingly, a second pulse of high pressure gas is supplied to extend fractures into the zone 16 from the reservoir 66 in somewhat the same manner as provided by operation of the valve 50 in the embodiment of FIG. 1 to provide a pressure gas charge from the reservoir 42. Alternatively, the shear disk 94 may be eliminated and firing of the perforation gun 30 used to release or to control flow of pressure gas from tubing string 20, reservoir 66 and wellbore space 28 into the formation.

Still further, if the perforations 26 already exist, a shear disk apparatus 62 may be placed at the distal end 20*a* of the tubing string 20 and the tubing string pressurized with gas to a pressure sufficient to effect release of the shear disk 62 and then followed by shearing of the disk 94 so that two charges or pulses of pressure gas act sequentially on the formation zone 16 to initiate and/or extend fractures therein.

The systems illustrated in FIGS. 1 and 2 may also be operated in accordance with the invention by pressurizing the wellbore space 28 and the tubing string 20 to an intermediate pressure, say about 4,000 to 5,000 psig, less than the pressure in the reservoirs 42 or 66 prior to initiation and/or extension of a fracture into the formation zone 16. Accordingly, the shear disk 94, for example, may be configured to release flow of pressure gas from the reservoir 66 once a pressure differential greater than the charge pressure differential in the tubing string 20 and the working pressure of the reservoir is reached, such as upon firing the perforation gun 30. Formation breakdown pressure requirements and well structure pressure limits may dictate the charging pressure of the tubing string 20 and the wellbore space 28.

The foregoing description is believed to be sufficient to enable one skilled in the art to practice the present invention. Those skilled in the art will recognize that a selected formation zone may be fractured in accordance with the invention without the specific well structure described hereinabove. For example, the tubing string may not be present in the well and the pressure gas may be conducted through a wellbore space defined by the casing 18 or similar wellbore structure. The wellbore space 28 may also be defined by an "open hole" wellbore, that is without a casing lining the wellbore wall. Moreover, although the reservoirs 42 and 66 provide certain advantages, the specific configuration of the reservoir may be modified without departing from the other advantages and features of the invention.

Although preferred embodiments have been described in some detail herein, those skilled in the art will also recognize that various substitutions and modifications may be made to the invention within the scope and spirit of the appended claims.

What is claimed:

1. A method for forming a fracture in an earth formation having a wellbore penetrating said formation comprising the steps of:

connecting a reservoir of high pressure gas disposed at the earth's surface to said wellbore by conduit means in fluid flow communication with said wellbore, said conduit means having flow control means interposed therein; and actuating said flow control means to release a charge of high pressure gas from said reservoir to flow through said wellbore to form said fracture.

2. The method set forth in claim 1 including the step of:

providing pressure fluid in said wellbore at a predetermined pressure prior to actuating said flow control means.

3. The method set forth in claim 2 including the step of:

raising the pressure of said pressure fluid in said wellbore to a predetermined pressure less than the pressure of pressure gas in said reservoir.

4. The method set forth in claim 3 including the step of:

causing said pressure fluid to flow into said formation before releasing said charge of pressure gas.

5. The method set forth in claim 4 including the step of:

initiating perforations from said wellbore into said formation to cause pressure fluid in said wellbore to flow into said formation and release of pressure gas from said reservoir to flow through said wellbore into said formation.

6. The method set forth in claim 5 including the step of:

providing at least part of said conduit means extending within said wellbore and having closure means disposed therein for containing a charge of pressure fluid in said conduit means, said portion of said conduit means being operable to be connected to said reservoir; and causing said closure means to release a charge of pressure fluid from said conduit means to flow into said formation, and, upon the release of pressure fluid in said conduit means, causing said flow control means to release a charge of pressure gas from said reservoir to flow through said conduit means to said earth formation.

7. The method set forth in claim 5 including the steps of:

providing control means operable to control forming said perforations and the operation of said flow control means to release a charge of pressure gas from said reservoir to flow to said formation at a predetermined time in relation to the time of forming of said perforations.

8. The method set forth in claim 4 wherein:

said pressure fluid is provided as a gas.

9. The method set forth in claim 8 wherein:

said pressure fluid is provided as nitrogen gas.

10. A method for forming a fracture in an earth formation penetrated by a well extending from the earth's surface and having a casing extending within said earth formation, comprising:

placing a casing perforation forming device in said well at a selected position therein;

connecting a reservoir of high pressure gas disposed at the earth's surface to said well to provide a charge of high pressure gas to flow through said well and into said formation;

providing flow control means interposed in conduit means extending between said reservoir and said casing in the vicinity of perforations to be formed therein;

forming said perforations; and releasing pressure gas to flow from said reservoir through said well in timed relation to the formation of said perforations to effect forming fractures in said earth formation extending from said perforations.

11. The method set forth in claim 10 including the step of:

pumping pressure fluid into said well prior to actuation of said perforation forming device to increase the fluid pressure in said well to a predetermined amount.

12. The method set forth in claim 11 wherein:

said flow control means is responsive to a differential pressure acting thereacross and the step of effecting operation of said flow control means to release pressure gas from said reservoir is carried out by placing said well in communication with said reservoir through said flow control means and reducing the fluid pressure in said well to effect actuation of said flow control means to release pressure gas to flow into said well from said reservoir.

13. The method set forth in claim 11 including the steps of:

providing a controller for actuating said perforation forming device and said flow control means; and actuating said perforation forming device and actuating said flow control means in timed relation to provide a charge of pressure gas from said reservoir to flow through said well upon forming said perforations in said casing.

14. A method for forming a fracture in an earth formation penetrated by a well extending from the earth's surface, comprising:

connecting a reservoir of high pressure gas disposed on the earth's surface to said well to provide a charge of high pressure gas to flow through said well and into said formation;

providing flow control means interposed in conduit means extending between said reservoir and a wellbore space in the vicinity of a zone of interest in said earth formation to be fractured;

precharging said conduit means between said flow control means and said wellbore space with pressure fluid at an intermediate pressure; and releasing pressure gas to flow from said reservoir through said well to effect forming fractures in said formation.

15. The method set forth in claim 14 including the step of:

causing said pressure fluid to flow into said formation and prior to release of said gas to provide a sequential flow of fluid into said formation in two distinct pulses to effect initiations and/or extension of said fracture.

16. A system for fracturing an earth formation from a well penetrating said formation, said well having a casing, a wellhead disposed at the earth's surface and connected to said casing, comprising:

a casing perforation forming device disposed in said well and connected to signal transmitting means;

a reservoir of high pressure gas disposed at the earth's surface;

conduit means interconnecting said reservoir with said wellbore through said wellhead;

flow control means interposed in said conduit means between said reservoir and a portion of said wellbore between said wellhead and the position of said perforation forming device;

means for providing a charge of pressure fluid in said wellbore; and means for effecting operation of said device to provide perforations in said casing and for effecting actuation of said flow control means to release pressure gas to flow into said earth formation through said perforations.

17. The system set forth in claim 16 wherein:

said flow control means comprises a shear disk apparatus interposed in said conduit means.

18. The system set forth in claim 16 wherein:

said flow control means comprises a motor operated valve.

19. The system set forth in claim 16 wherein:

said reservoir comprises a first pressure vessel interposed within a second pressure vessel in spaced relationship to provide a space for occupation by a pressure fluid operable to reduce the pressure differential acting across said first pressure vessel and wherein said first pressure vessel contains a quantity of said high pressure gas.

20. The system set forth in claim 16 wherein:

said reservoir is formed of plural interconnected sections of high pressure well casing having a nominal working pressure rating at least as great as the working pressure of said high pressure gas.

* * * * *